US009215771B2

(12) United States Patent
Lin et al.

(10) Patent No.: US 9,215,771 B2
(45) Date of Patent: Dec. 15, 2015

(54) LIGHT EMITTING DIODE DRIVER

(71) Applicant: RICHTEK TECHNOLOGY CORP., Chupei, Hsinchu (TW)

(72) Inventors: Chien-Hua Lin, Xiushui Township, Changhua County (TW); Shui-Mu Lin, Taichung (TW)

(73) Assignee: RICHTEK TECHNOLOGY CORP., Hsinchu (TW)

( * ) Notice: Subject to any disclaimer, the term of this patent is extended or adjusted under 35 U.S.C. 154(b) by 326 days.

(21) Appl. No.: 13/973,681

(22) Filed: Aug. 22, 2013

(65) Prior Publication Data

US 2014/0320041 A1 Oct. 30, 2014

(30) Foreign Application Priority Data

Apr. 24, 2013 (TW) ..... 102114590 A

(51) Int. Cl.
*H05B 37/02* (2006.01)
*H05B 33/08* (2006.01)

(52) U.S. Cl.
CPC ..... *H05B 33/0842* (2013.01)

(58) Field of Classification Search
CPC ..... H05B 37/02; H05B 39/04; H05B 41/38
See application file for complete search history.

(56) References Cited

U.S. PATENT DOCUMENTS 9,030,126 B2 * 5/2015 Tsao ..... H05B 33/0848 315/192

FOREIGN PATENT DOCUMENTS

TW 201210405 A 3/2012

OTHER PUBLICATIONS

English translation of a Search Report dated Feb. 5, 2015, included in an Office Action issued Feb. 6, 2015, in corresponding Taiwan Patent Application No. TW-102114590 (2 pages).

* cited by examiner

*Primary Examiner* — Hai L Nguyen
(74) *Attorney, Agent, or Firm* — Osha Liang LLP

(57) ABSTRACT

A light emitting diode driver includes: a serial-to-parallel conversion unit converting, based on a reference clock signal, a serial input signal carrying a number (N) of M-bit gray codes into a parallel input signal carrying the M-bit gray codes; a counting unit counting an output control signal to output a counting value; a data buffer unit storing, based on a latch signal, the M-bit gray codes carried by the parallel input signal, and outputting, based on the counting value and the M-bit gray codes, an N-bit signal consisting of N bits, each of which is an $i^{th}$ one of M bits of a respective M-bit gray code, where i is associated with the counting value; and an output unit generating a number (N) of driving current signals based on at least the N-bit signal.

13 Claims, 17 Drawing Sheets

T1
$2^{14}$T
8T
4T
2T
T
T
output control signal
counting value
reference current
I
(1/2) I T1
$2^{13}$T
8T
4T
2T
T
T
T
output control signal
counting value
reference current
I
(1/2) I
(1/4) I T1
$2^{14}$T
4T
2T
T
T
I
(1/2) I
output control signal
counting value
reference current T1
$2^{14}$T
4T
2T
T
T
I
(1/2) I
output control signal
counting value
reference current T1
$2^{13}$T
4T
2T
T
T
T
I
(1/2) I
(1/4) I
output control signal
counting value
reference current T1
$2^{13}$T
4T
2T
T
T
T
output control signal
counting value
reference current
I
(1/2) I
(1/4) I

LIGHT EMITTING DIODE DRIVER

CROSS-REFERENCE TO RELATED APPLICATION

This application claims priority of Taiwanese Application No. 102114590, filed on Apr. 24, 2013, the contents of which are hereby incorporated by reference.

BACKGROUND OF THE INVENTION

1. Field of the Invention

This invention relates to a driver, and more particularly to a light emitting diode driver.

2. Description of the Related Art

Referring to FIGS. 1 and 2, a first conventional light emitting diode (LED) driver 1 is shown to generate sixteen driving current signals, which are used to respectively drive sixteen light emitting units 2. Each of the light emitting units 2 may include at least one LED 21. FIG. 1 shows an example, in which each of the light emitting units 2 includes only one LED 21. The first conventional LED driver 1 includes a serial-to-parallel conversion unit 11, a data buffer unit 12, and an output unit 13.

The serial-to-parallel conversion unit 11 receives a reference clock signal, and a serial input signal carrying sixteen 16-bit gray codes. The serial-to-parallel conversion unit 11 is operable to convert, based on the reference clock signal, the serial input signal into a parallel input signal carrying the 16-bit gray codes. All sixteen $i^{th}$ bits of all of the 16-bit gray codes are converted at a time, where $1 \leq i \leq 16$. Therefore, sixteen conversion operations are required for generation of the parallel input signal.

The data buffer unit 12 has a storage capacity of 16 bits. The data buffer unit 12 is coupled to the serial-to-parallel conversion unit 11 for receiving the parallel input signal therefrom, and further receives a latch signal. The data buffer unit 12 is operable to store, based on the latch signal, the sixteen $i^{th}$ bits of all of the 16-bit gray codes carried by the parallel input signal.

The output unit 13 is coupled to the data buffer unit 12 for receiving the bits stored thereby, and further receives an output control signal. During each cycle (T1), the output control signal non-periodically changes between a logic low level and a logic high level, and non-duty cycles of the output control signal during which the output control signal is at the logic low level gradually increase by a geometric sequence with a common ratio of 2. That is to say, the non-duty cycles sequentially are T, 2T, 4T, 8T, . . . , and $2^{15}$T. The output unit 13 is operable to generate the driving current signals based on the output control signal and the bits, such that each of the driving current signals has a current value, which is determined based on a respective one of the bits to be a predetermined current value (if the respective one of the bits is '1') or zero (if the respective one of the bits is '0') when the output control signal is at the logic low level, and which is zero when the output control signal is at the logic high level.

The current value of each driving current signal is determined based on the $i^{th}$ bit of a respective 16-bit gray code within a duration of $2^{i-1}$T. Accordingly, an average luminance of each light emitting unit 2 is proportional to a gray value represented by the respective 16-bit gray code.

However, since the data buffer unit 12 stores only sixteen bits to be used at a time, a time period between any two adjacent ones of falling edges of the output control signal (e.g., the time period (T2) between first and second falling edges of the output control signal) must be sufficient to serially input sixteen bits to the serial-to-parallel conversion unit 11. Therefore, the first conventional LED driver 1 is disadvantageous in that a refresh rate (i.e., 1/T1) of each driving current signal is limited by a rate at which the bits are inputted to the serial-to-parallel conversion unit 11.

Referring to FIGS. 3 and 4, a second conventional LED driver 3 is shown to generate sixteen driving current signals, which are used to respectively drive sixteen light emitting units 4. Each of the light emitting units 4 may include at least one LED 41. FIG. 3 shows an example, in which each of the light emitting units 4 includes two LEDs 41. The second conventional LED driver 3 includes a serial-to-parallel conversion unit 31, a data buffer unit 32, a control unit 33, and an output unit 34.

The serial-to-parallel conversion unit 31 receives a reference clock signal, and a serial input signal carrying sixteen 16-bit gray codes. The serial-to-parallel conversion unit 31 is operable to convert, based on the reference clock signal, the serial input signal into a parallel input signal carrying the 16-bit gray codes.

The data buffer unit 32 has a storage capacity of 16×16 bits. The data buffer unit 32 is coupled to the serial-to-parallel conversion unit 31 for receiving the parallel input signal therefrom, and further receives a latch signal. The data buffer unit 32 is operable to store, based on the latch signal, the 16-bit gray codes carried by the parallel input signal.

The control unit 33 is coupled to the data buffer unit 32 for receiving the 16-bit gray codes stored thereby, and further receives an output control signal. The output control signal periodically changes between a logic low level and a logic high level by a predetermined frequency (i.e., 1/T) during each cycle. The control unit 33 is operable to generate sixteen pulse width control signals, each of which is generated based on the output control signal and a respective one of the 16-bit gray codes.

The output unit 34 is coupled to the control unit 33 for receiving the pulse width control signals therefrom, and further receives the output control signal. The output unit 34 is operable to generate the driving current signals based on the output control signal and the pulse width control signals such that each of the driving current signals has pulse widths (T1-T64), which are determined based on the output control signal and a respective one of the pulse width control signals. A sum of the pulse widths (T1-T64) of each of the driving current signals during each cycle of the output control signal (i. e., T1+T2+ . . . +T64) is proportional to a gray value represented by a respective one of the 16-bit gray codes. Therefore, an average luminance of each of the light emitting units 2 is proportional to the gray value represented by the respective one of the 16-bit gray codes.

Since the data buffer unit 32 can pre-store the 16-bit gray codes to be used, an interval waiting time for serially inputting the 16-bit gray codes to the serial-to-parallel conversion unit 31 can be reduced. Therefore, a refresh rate of each of the driving current signals of the second conventional LED driver 3 can be raised compared to that of the first conventional LED driver 1 of FIG. 1.

However, the control unit 33 required to control the pulse widths of each of the driving current signals is relatively complex. Therefore, the second conventional LED driver 3 disadvantageously has a relatively high cost.

SUMMARY OF THE INVENTION

Therefore, an object of the present invention is to provide a light emitting diode driver that can overcome the aforesaid drawbacks associated with the prior arts.

According to this invention, there is provided a light emitting diode (LED) driver for generating a number (N) of driving current signals for respectively driving a number (N) of light emitting units, where N≥2. Each of the light emitting units includes at least one LED. The LED driver comprises a serial-to-parallel conversion unit, a counting unit, a data buffer unit, and an output unit. The serial-to-parallel conversion unit is adapted to receive a reference clock signal, and a serial input signal carrying a number (N) of M-bit gray codes, where M≥2. The serial-to-parallel conversion unit is operable to convert, based on the reference clock signal, the serial input signal into a parallel input signal carrying the M-bit gray codes. The counting unit is adapted to receive an output control signal, and is operable to count the output control signal so as to output a counting value. The data buffer unit is coupled to the serial-to-parallel conversion unit and the counting unit for receiving the parallel input signal and the counting value respectively therefrom, and is adapted to receive a latch signal. The data buffer unit is operable to store, based on the latch signal, the M-bit gray codes carried by the parallel input signal, and to output, based on the counting value and the M-bit gray codes, an N-bit signal consisting of a number (N) of bits, each of which is an $i^{th}$ one of M bits of a respective one of the M-bit gray codes, where $1 \le i \le M$, and i is associated with the counting value. The output unit is coupled to the data buffer unit for receiving the N-bit signal therefrom. The output unit is operable to generate the driving current signals based on at least the N-bit signal.

BRIEF DESCRIPTION OF THE DRAWINGS

Other features and advantages of the present invention will become apparent in the following detailed description of the preferred embodiments of this invention, with reference to the accompanying drawings, in which.

DETAILED DESCRIPTION OF THE PREFERRED EMBODIMENTS

Figure 5:
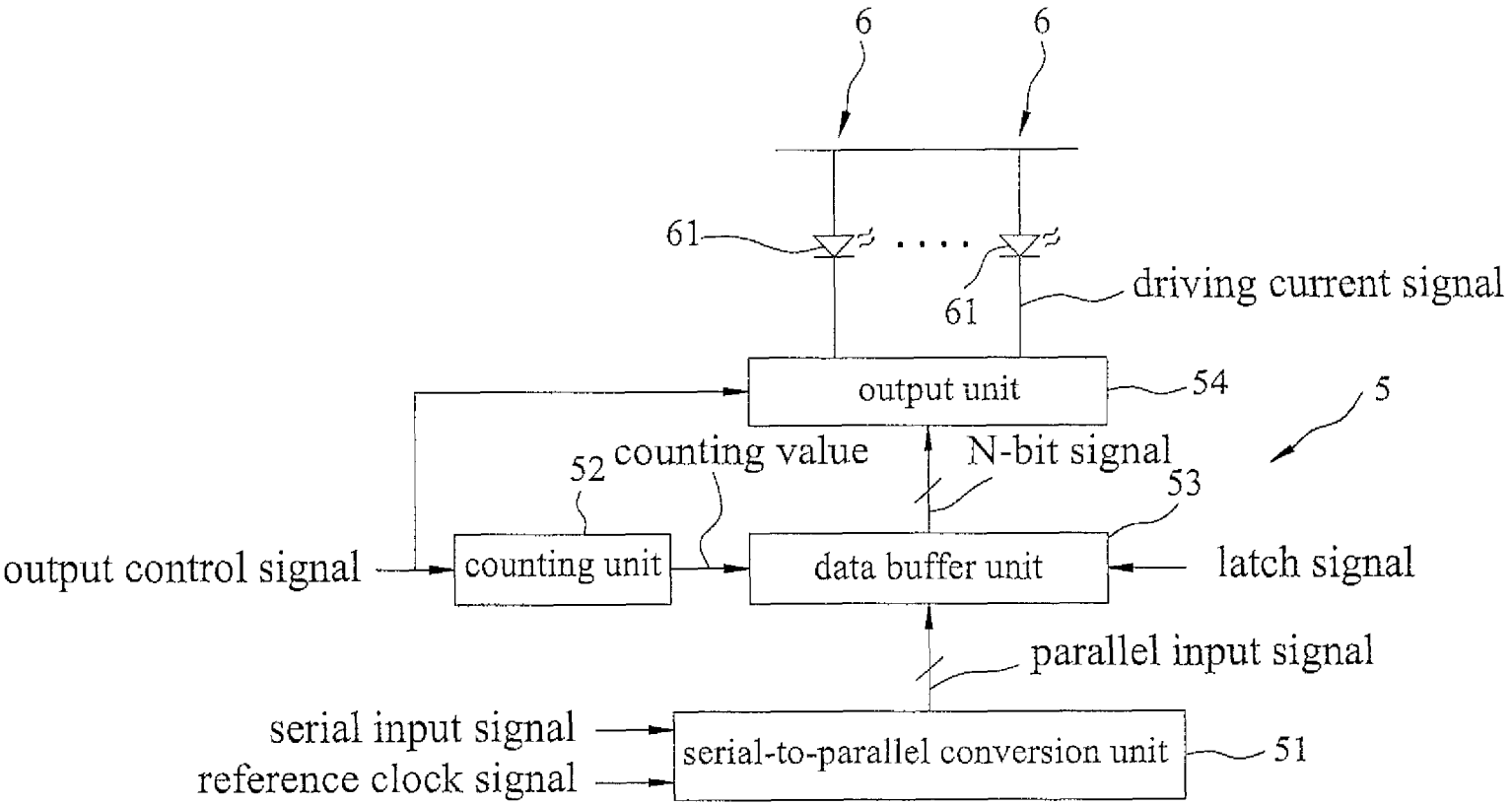
FIG. 5 is a schematic block diagram illustrating the first preferred embodiment of a light emitting diode driver according to this invention.

Referring to FIG. 5, the first preferred embodiment of a light emitting diode (LED) driver 5 according to this invention is shown to generate a number (N) of driving current signals, which are adapted to respectively drive a number (N) of light emitting units 6, where N≥2. Each of the light emitting units 6 may include at least one LED 61. In this embodiment, each of the light emitting units 6 includes only one LED 61. The LED driver 5 includes a serial-to-parallel conversion unit 51, a counting unit 52, a data buffer unit 53, and an output unit 54.

The serial-to-parallel conversion unit 51 is adapted to receive a reference clock signal, and a serial input signal carrying a number (N) of M-bit gray codes, where M≥2. The serial-to-parallel conversion unit 51 is operable to convert, based on the reference clock signal, the serial input signal into a parallel input signal carrying the M-bit gray codes. In this embodiment, M is, but not limited to, 16.

Figures 6A, 6B:
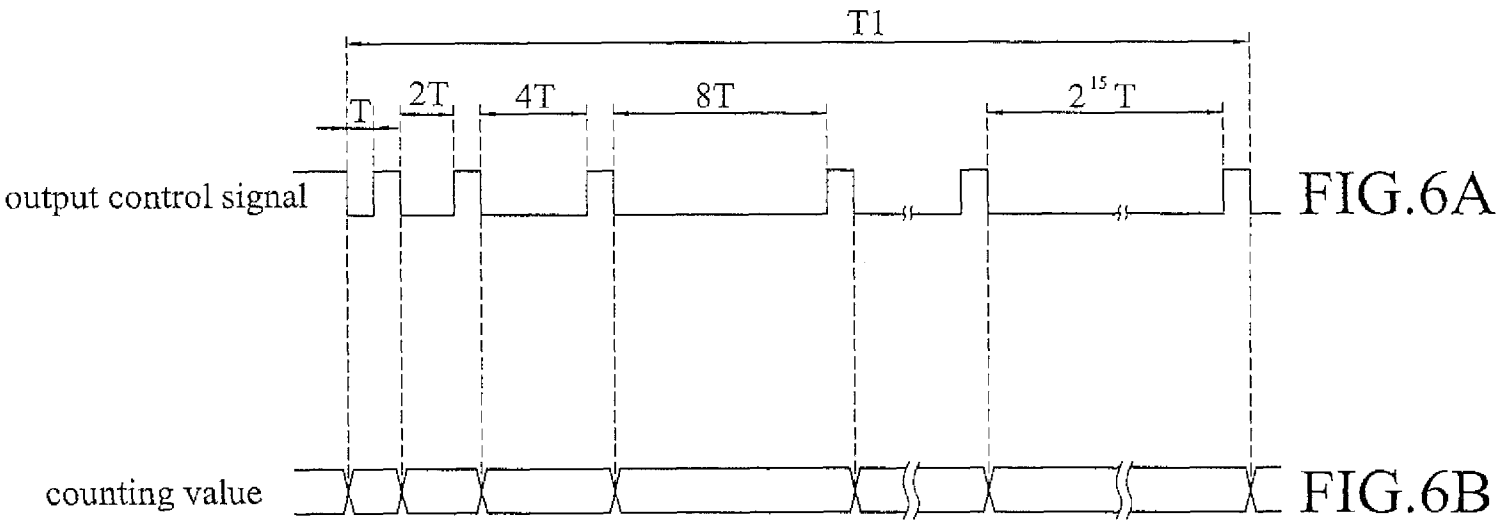
FIGS. 6A and 6B are timing diagrams illustrating an output control signal and a counting value of the light emitting diode driver of the first preferred embodiment, respectively.

The counting unit 52 is, for example, a counter, and is adapted to receive an output control signal for counting the output control signal so as to output a counting value. In this embodiment, as shown in FIG. 6A, during each cycle (T1), the output control signal non-periodically changes between a first level (e.g., a logic low level) and a second level (e.g., a logic high level), and non-duty cycles of the output control signal during which the output control signal is at the first level (i.e., the logic low level) gradually increase by a geometric sequence with a common ratio of 2. That is to say, the non-duty cycles sequentially are T, 2T, 4T, 8T, . . . , and $2^{15}$T. The counting unit 52 changes the counting value upon each transition of the output control signal from a selected one of the first and second levels to the other of the first and second levels. In this embodiment, as shown in FIG. 6B, the counting value outputted by the counting unit 52 changes upon each transition of the output control signal from the second level (logic high level) to the first level (logic low level), namely, the falling-edge transition. In other embodiments, the counting value may be configured to change upon each transition of the output control signal from the first level (logic low level) to the second level (logic high level), namely, the rising-edge transition, or the first level can be the logic high level while the second level can be the logic low level.

The data buffer unit 53 has a storage capacity of N×M bits. The data buffer unit 53 is coupled to the serial-to-parallel conversion unit 51 and the counting unit 52 for receiving the parallel input signal and the counting value therefrom, respectively, and is adapted to receive a latch signal. The data buffer unit 53 is operable to store, based on the latch signal, the M-bit gray codes carried by the parallel input signal, and to output, based on the counting value and the M-bit gray codes, an N-bit signal consisting of a number (N) of bits, each of which is selected from an $i^{th}$ one of M bits of a respective one of the M-bit gray codes, where $1 \le i \le M$, and i is associated with the counting value. For example, the data buffer unit 53 may use the counting value as an indicator or an address so as to output the N-bit signal corresponding to the counting value.

The output unit 54 is coupled to the data buffer unit 53 for receiving the N-bit signal therefrom, and is adapted to further receive the output control signal. The output unit 53 is operable to generate the driving current signals based on the output control signal and the N-bit signal. In this embodiment, each of the driving current signals has a current value, which is determined based on a respective one of the bits of the N-bit signal to be a predetermined current value (if the respective one of the bits of the N-bit signal is '1') or zero (if the respective one of the bits of the N-bit signal is '0') when the output control signal is at the first level, and which is zero when the output control signal is at the second level.

In this embodiment, the current value of each driving current signal is determined based on the $i^{th}$ one of the bits of a respective M-bit gray code within a duration of $2^{i-1}T$, where $1 \le i \le M$, and i is associated with the counting value. Accordingly, an average luminance of each of the light emitting units 6 is proportional to a gray value represented by the respective M-bit gray code.

Figure 1:
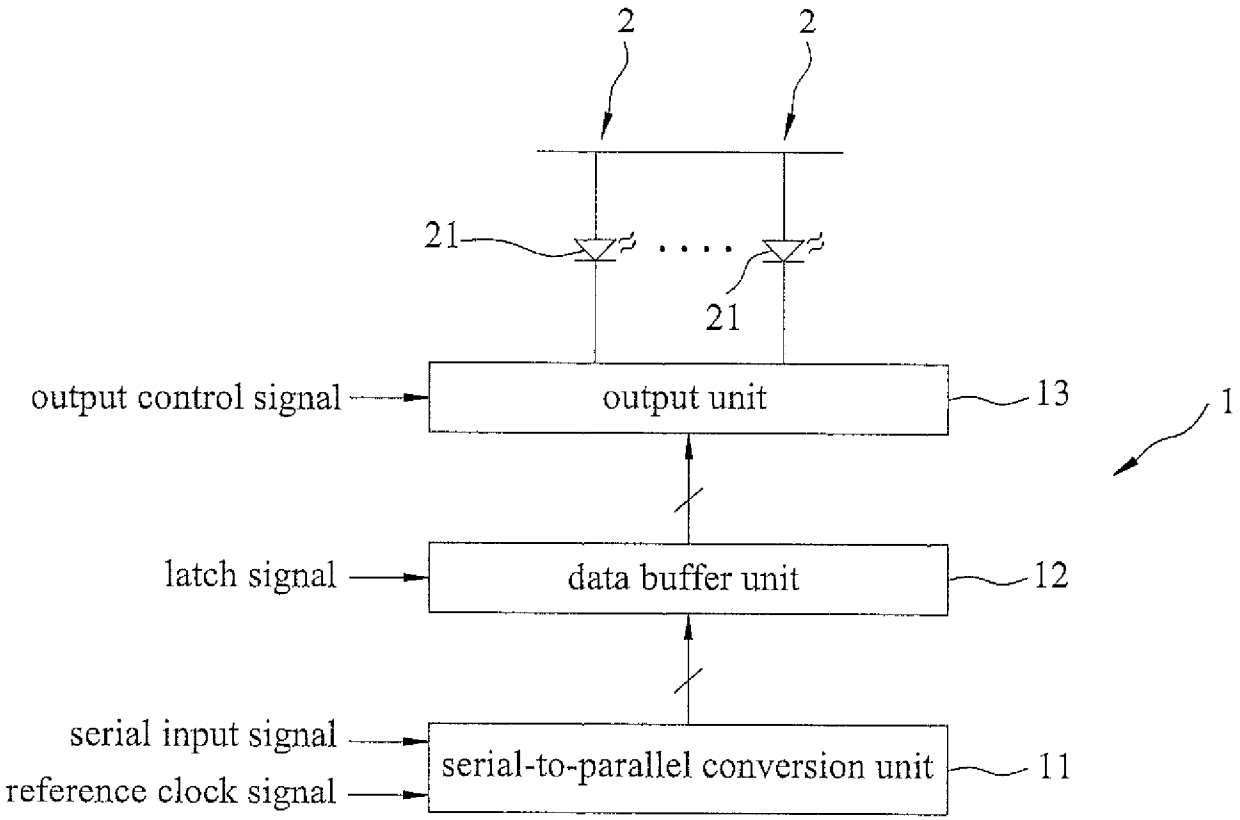
FIG.1 PRIOR ART
FIG. 1 is a schematic block diagram illustrating a first conventional light emitting diode driver.
Figure 2:
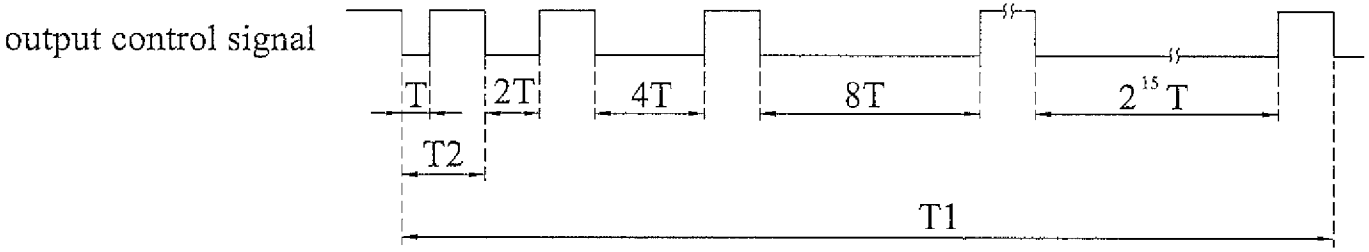
FIG.2 PRIOR ART
FIG. 2 is a timing diagram illustrating an output control signal of the first conventional light emitting diode driver.
Figure 3:
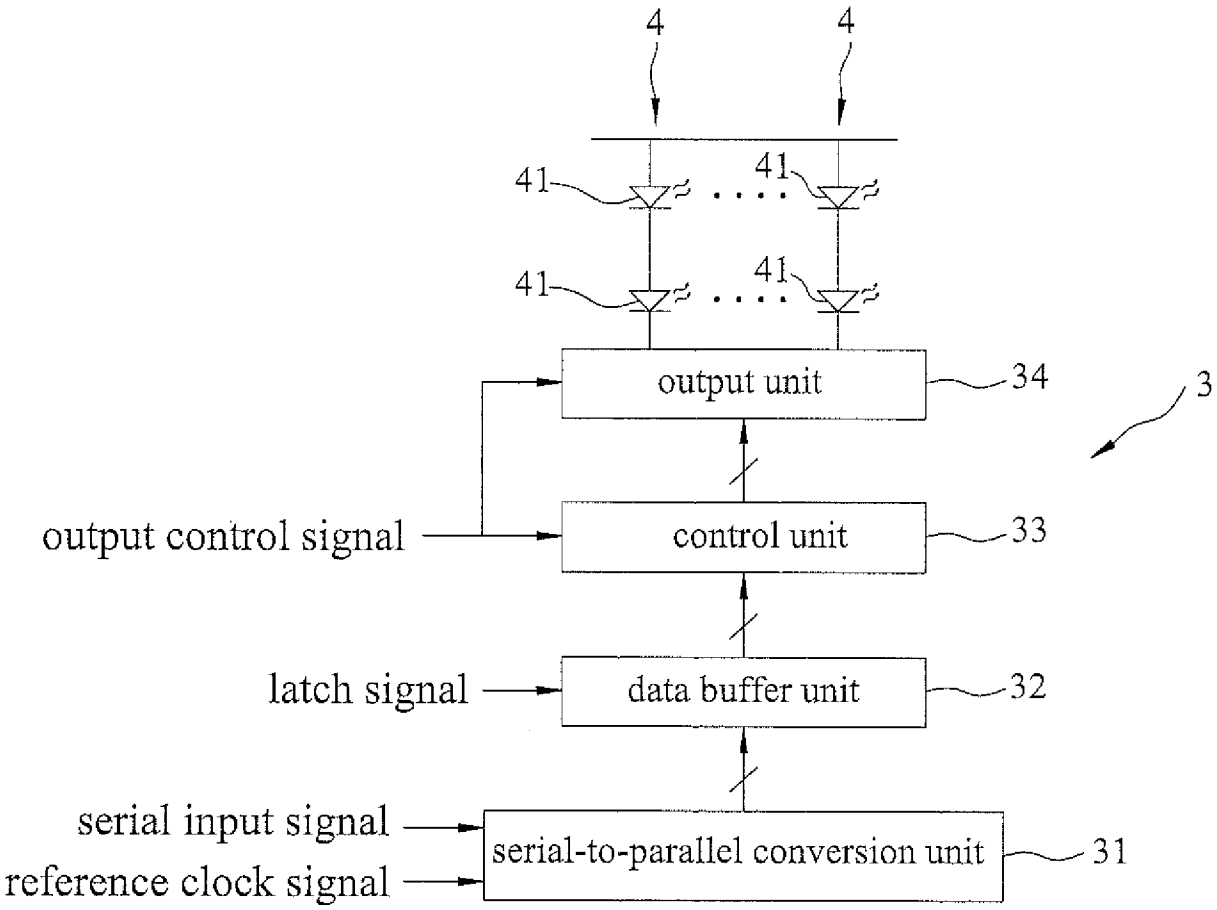
FIG.3 PRIOR ART
FIG. 3 is a schematic block diagram illustrating a second conventional light emitting diode driver.
Figure 4:
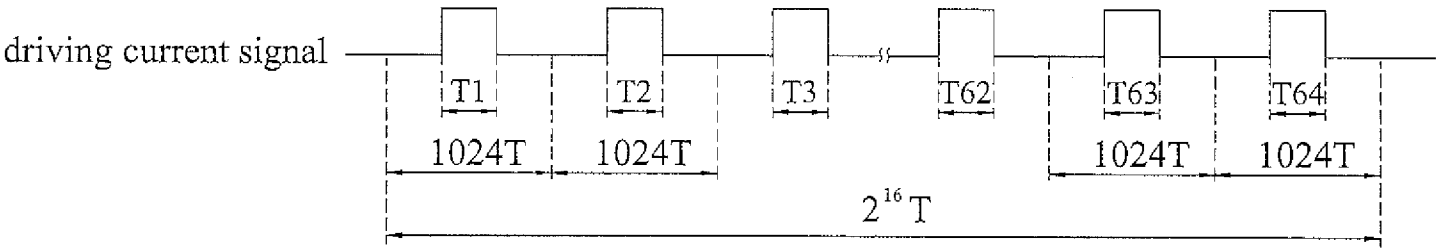
FIG.4 PRIOR ART
FIG. 4 is a timing diagram illustrating a driving current signal of the second conventional light emitting diode driver.

In view of the above, since the data buffer unit 53 can pre-store the M-bit gray codes to be used, an interval waiting time for serially inputting the M-bit gray codes to the serial-to-parallel conversion unit 51 can be reduced. As a result, a refresh rate of each of the driving current signals of the LED driver 5 of this embodiment can be raised compared to that of the first conventional LED driver 1 of FIG. 1. It is noted that the output control signal used in this embodiment is not a high frequency periodic signal, thereby resulting in relatively low interference with other signals from the output control signal compared to the second conventional LED driver 3 of FIG. 3.

Figure 7:
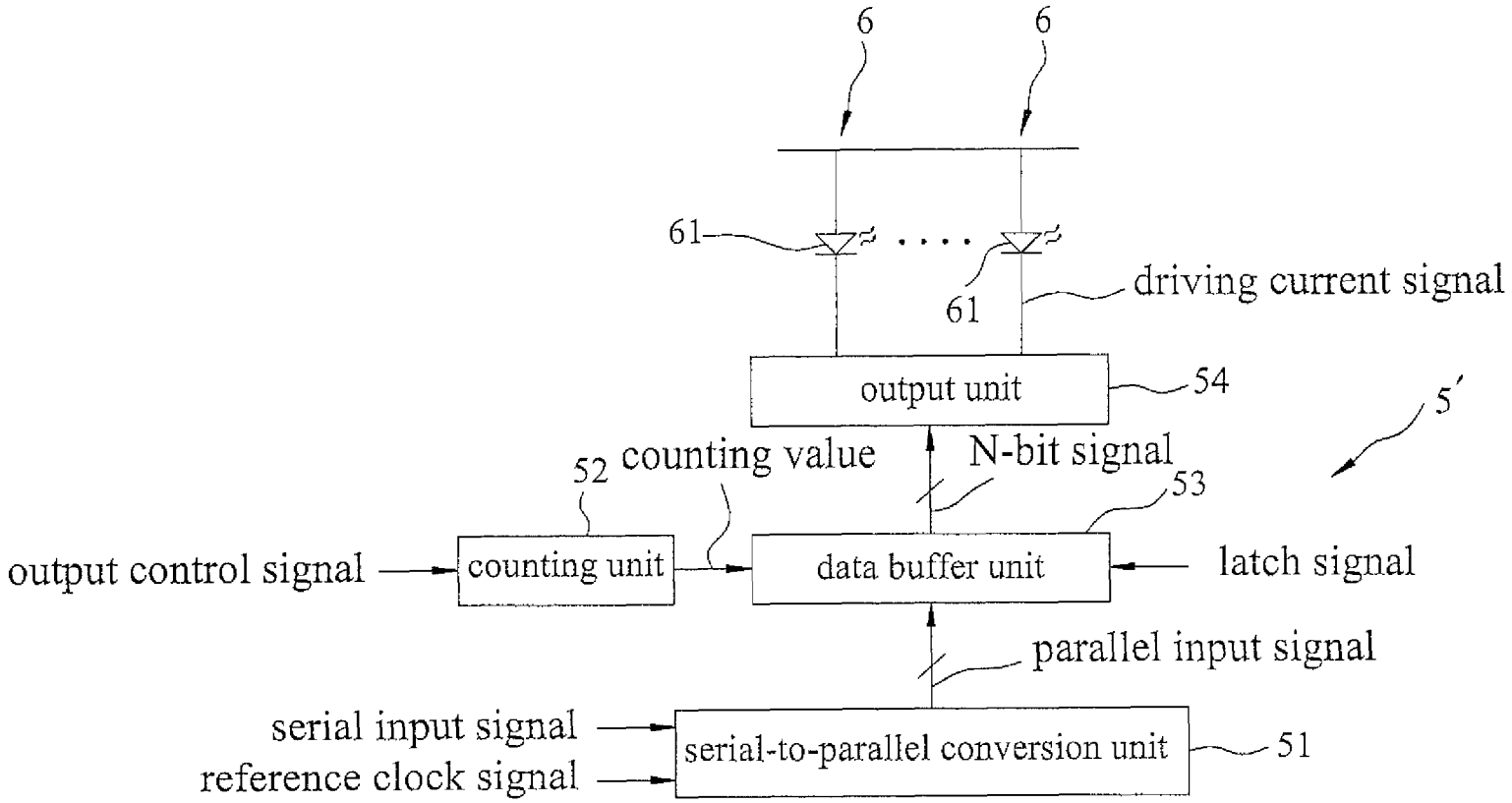
FIG. 7 is a schematic block diagram illustrating the second preferred embodiment of a light emitting diode driver according to this invention.

FIG. 7 illustrates the second preferred embodiment of an LED driver 5' according to this invention, and the LED driver 5' of this embodiment is a modification of the first preferred embodiment. Unlike the first preferred embodiment, the output unit 54 generates the driving current signals based only on the N-bit signal.

Figures 8A, 8B:
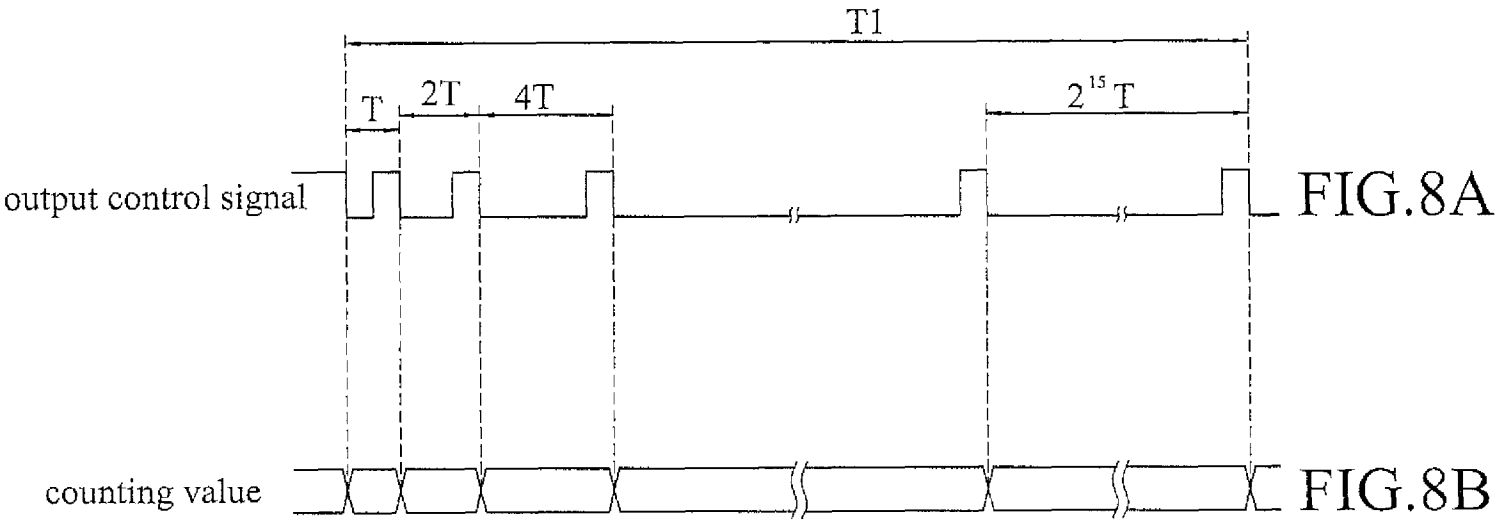
FIGS. 8A and 8B are exemplary timing diagrams illustrating an output control signal and a counting value of the light emitting diode driver of the second preferred embodiment, respectively.

In addition, the output control signal used in this embodiment differs from the output control signal (see FIG. 6A) used in the first preferred embodiment. For example, as shown in FIG. 8A, during each cycle (T1) of the output control signal, a time period between two adjacent falling-edge transitions of the output control signal gradually increases by a geometric sequence with a common ratio of 2. In this case, similar to the first preferred embodiment, the counting value outputted by the counting unit 52 changes upon each falling-edge transition of the output control signal, as shown in FIG. 8B. Accordingly, the current value of each of the driving current signals is constant during each time period between corresponding two adjacent falling-edge transitions of the output control signal, and is determined to be the predetermined current value or zero based on the N-bit signal, irrelevant to the output control signal. In other words, each of the light emitting units 6 emits light in the whole cycle (T1) of the output control signal when each of the bits of the respective one of the M-bit gray codes is '1'.

It is noted that the output control signal of FIG. 8A is not a high frequency periodic signal, thereby resulting in relatively low interference with other signals from the output control signal compared to the second conventional LED driver 3.

Figures 9A, 9B:
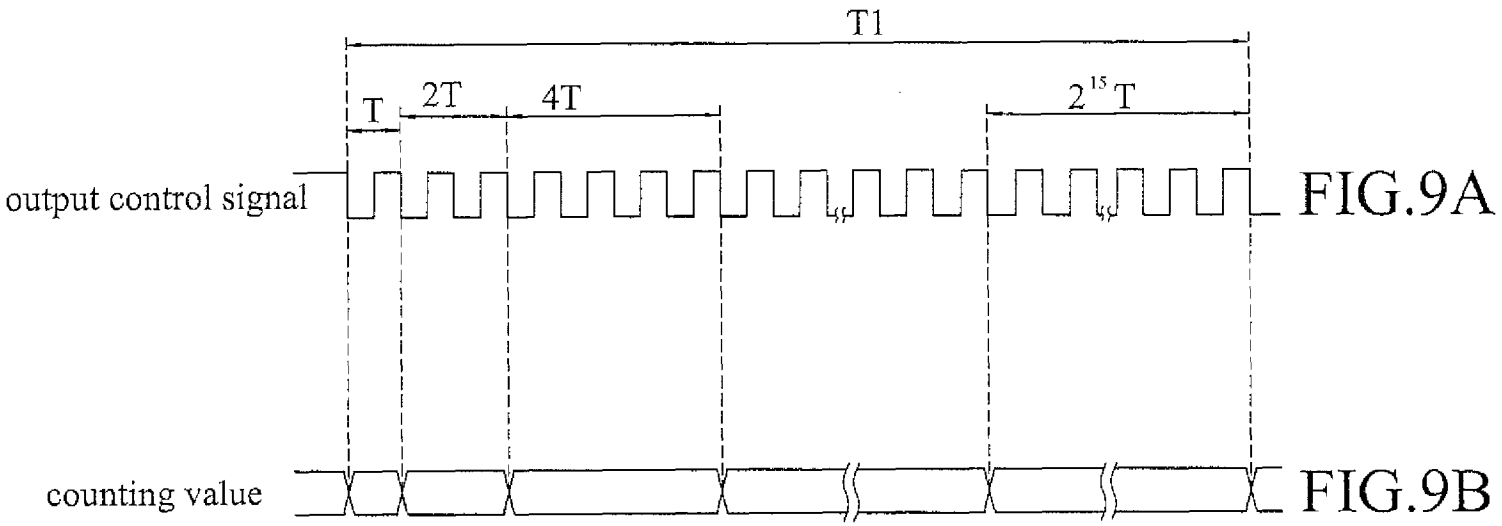
FIGS. 9A and 9B are another exemplary timing diagrams illustrating the output control signal and the counting value of the light emitting diode driver of the second preferred embodiment, respectively.

FIGS. 9A and 9B illustrate two other examples of the output control signal and the counting value, respectively. In the examples of FIGS. 9A and 9B, the output control signal periodically changes between the first and second levels by a predetermined frequency during the cycle (T1). In this case, different from the first preferred embodiment, the counting unit 52 changes the counting value upon each $(2^{j-1})^{th}$ falling-edge transition of the output control signal during each cycle (T1) of the output control signal, where $1 \le j \le M$. As a result, during each cycle (T1) of the output control signal, duration of the counting value gradually increases by a geometric sequence with a common ratio of 2.

Figure 10:
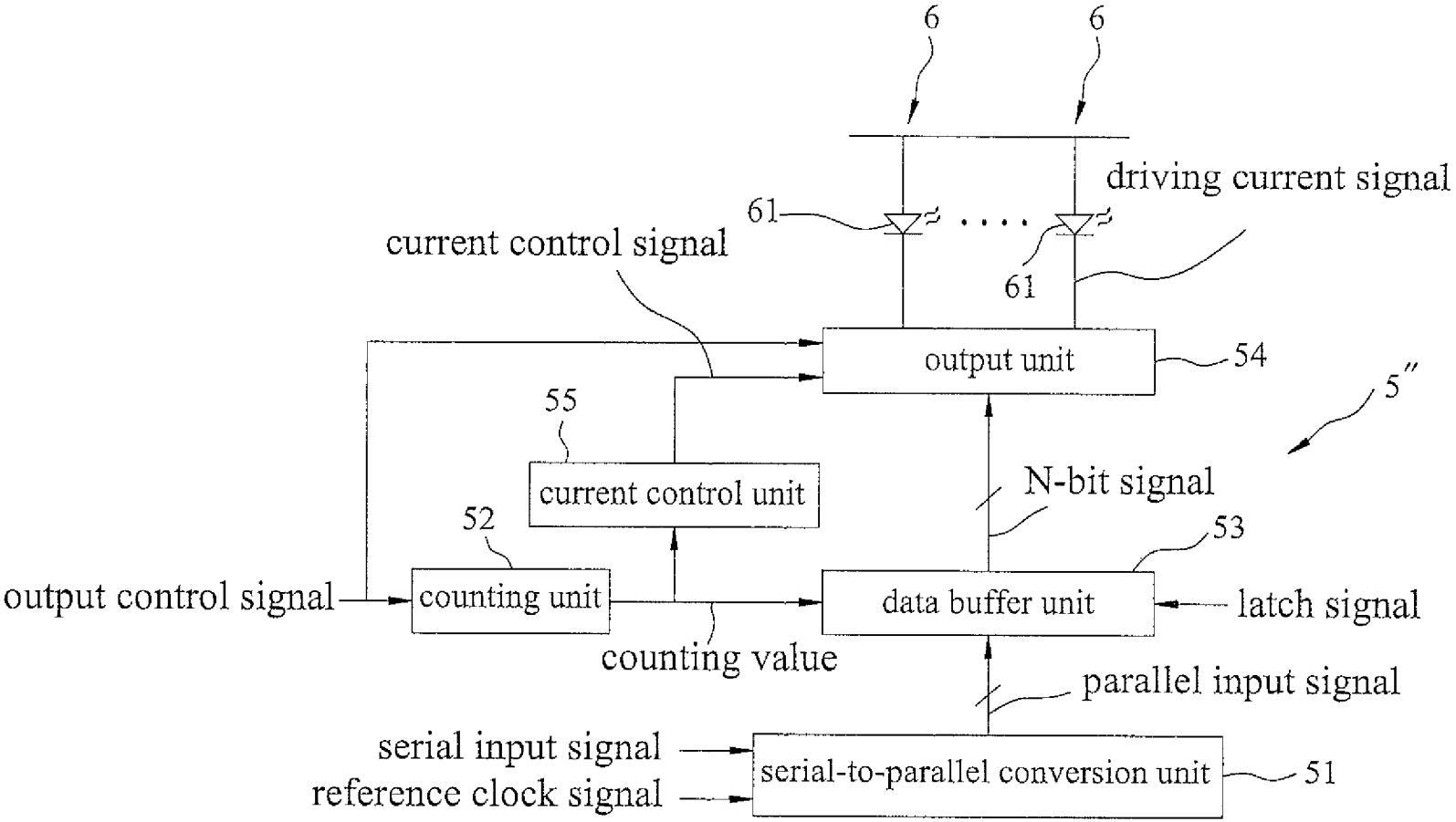
FIG. 10 is a schematic block diagram illustrating the third preferred embodiment of a light emitting diode driver according to this invention.

FIG. 10 illustrates the third preferred embodiment of an LED driver 5" according to this invention, and the LED driver 5" of this embodiment is a modification of the first preferred embodiment. Unlike the first preferred embodiment, the LED driver 5" further includes a current control unit 55. The current control unit 55 is coupled to the counting unit 52 and the output unit 54, and receives the counting value from the counting unit 52. The current control unit 55 is operable to generate, based on the counting value, a current control signal indicating a reference current, and outputs the current control signal to the output unit 54.

Figures 11A, 11B, 11C:
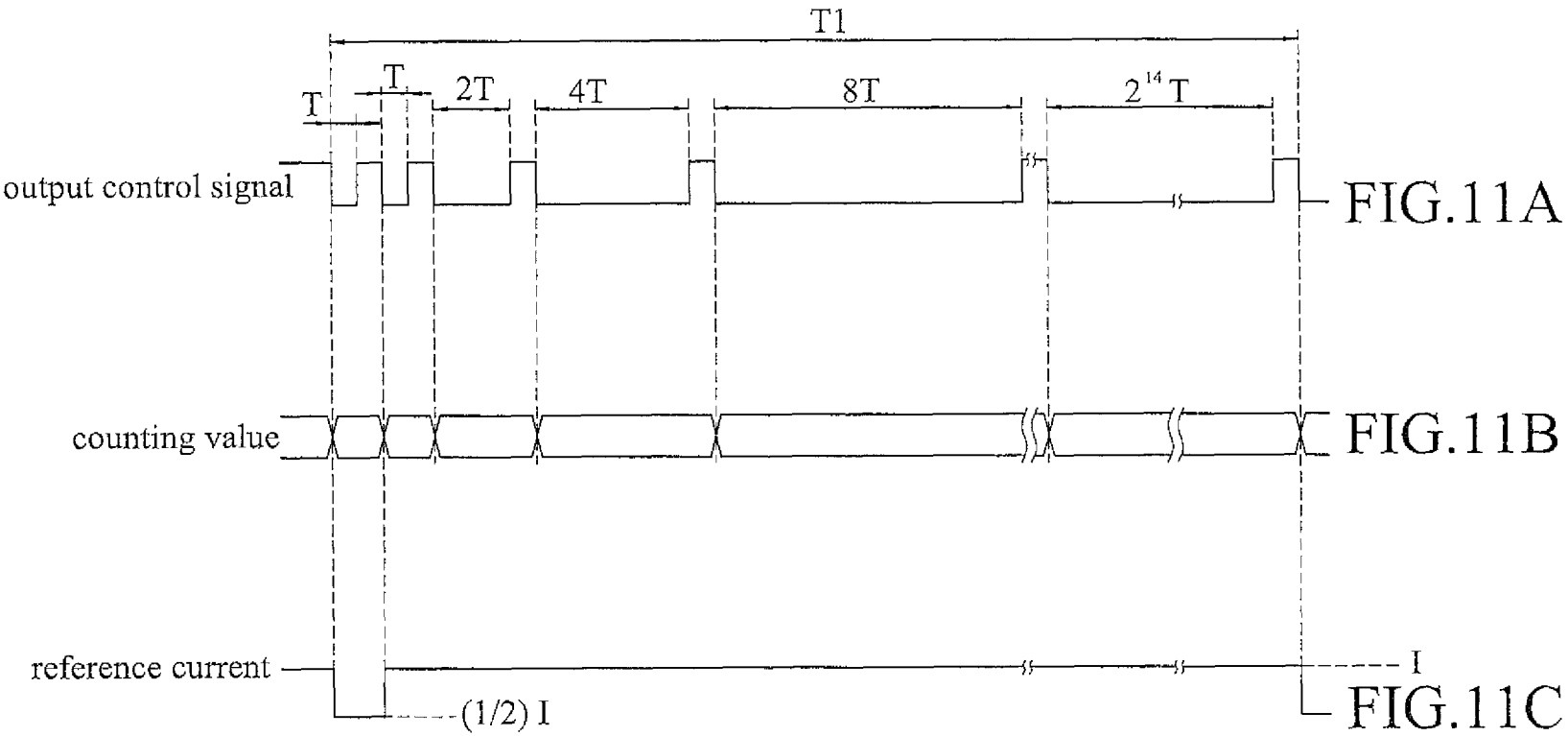
FIGS. 11A to 11C are exemplary timing diagrams illustrating an output control signal, a counting value and a reference current of the light emitting diode driver of the third preferred embodiment, respectively.

In addition, the output control signal used in this embodiment is a variation of the output control signal (see FIG. 6A) used in the first preferred embodiment. For example, as shown in FIG. 11A, during each cycle (T1) of the output control signal, non-duty cycles of the output control signal during which the output control signal is at the first level (i.e., the logic low level) are represented as a sequence of T, T, 2T, 4T, 8T, . . . , and $2^{14}T$. In this case, similar to the first preferred embodiment, the counting value outputted by the counting unit 52 changes upon each falling-edge transition of the output control signal, as shown in FIG. 11B.

In accordance with the output control signal of FIG. 11A and the counting value of FIG. 11B, the current control unit 55 configures the current control signal so that the reference current indicated by the current control signal has a predetermined current value (I) when $i \ge 2$, and is half the predetermined current value (I), i.e., (½)I, when i=1, as shown in FIG. 11C.

As a result, different from the first preferred embodiment, the output unit 54 further receives the current control signal from the current control unit 55, and generates, by a current mirror, the driving current signals based on the output control signal, the N-bit signal and the current control signal, such that each of the driving current signals has a current value, which is determined based on a respective one of the bits of the N-bit signal to be a value of the reference current (if the respective one of the bits of the N-bit signal is '1') or zero (if the respective one of the bits of the N-bit signal is '0') when the output control signal is at the first level (i.e., the logic low level) and which is zero when the output control signal is at the second level (i.e., the logic high level).

It is noted that, by using the current control unit 55 to change the current value of each of the driving current signals, the refresh rate of each of the driving current signals of the LED driver 5" of this embodiment can be raised compared to that of the first preferred embodiment, and can be almost double as M increases.

Figures 12A, 12B, 12C:
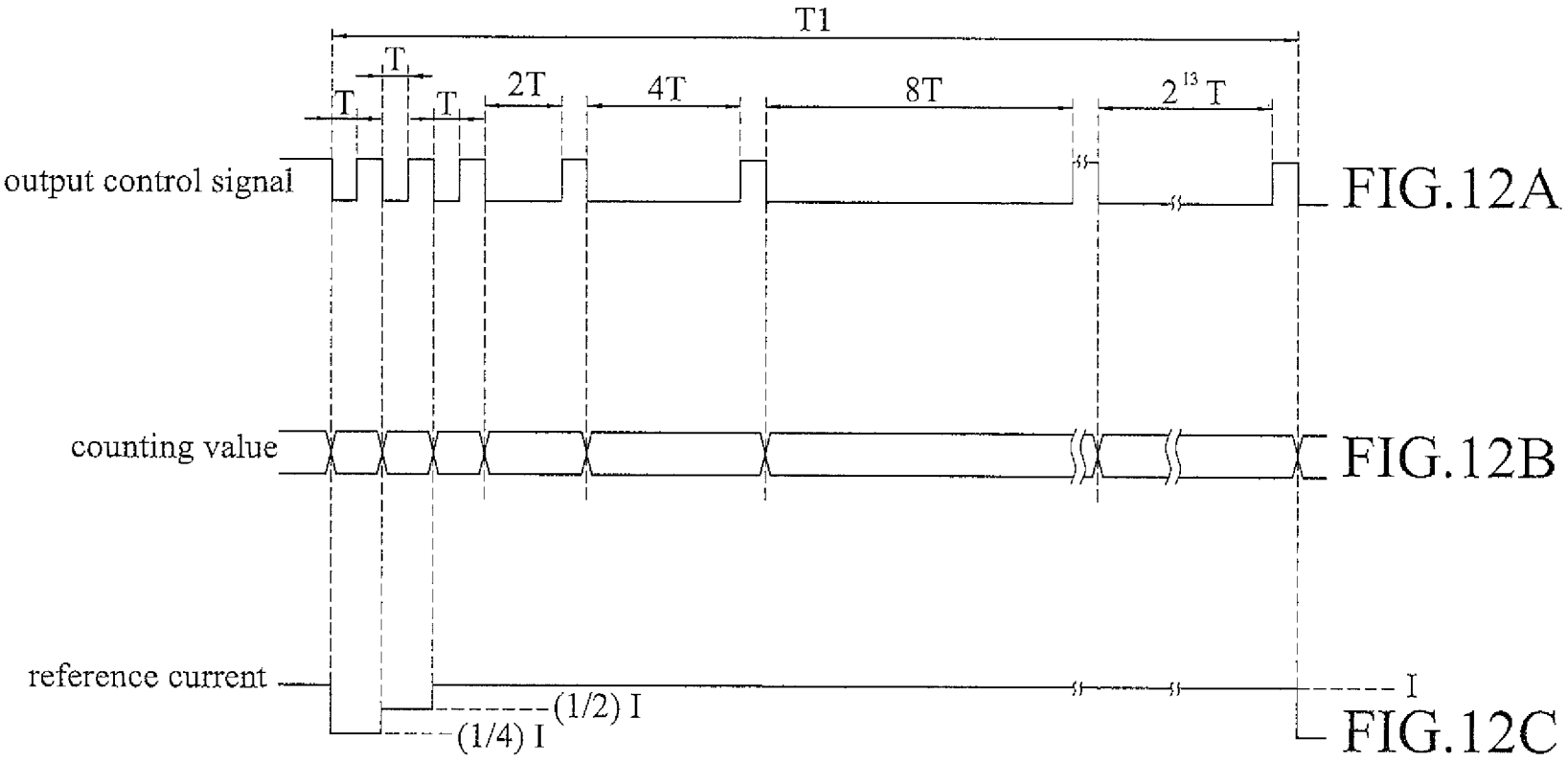
FIGS. 12A to 12C are another exemplary timing diagrams illustrating the output control signal, the counting value and the reference current of the light emitting diode driver of the third preferred embodiment, respectively.

FIGS. 12A to 12C illustrate three examples of the output control signal, the counting value and the reference current, respectively. In this example, M≥3, and the output control signal is a variation of the output control signal of FIG. 11A. That is, during each cycle (T1) of the output control signal, non-duty cycles of the output control signal during which the output control signal is at the first level (i.e., the logic low level) are represented as a sequence of T, T, T, 2T, 4T, 8T, . . . , and $2^{13}$T. In this case, similar to the first preferred embodiment, the counting value outputted by the counting unit 52 changes upon each falling-edge transition of the output control signal, as shown in FIG. 12B.

In accordance with the output control signal of FIG. 12A and the counting value of FIG. 12B, as shown in FIG. 12C, the current control unit 55 configures the current control signal, so that the reference current indicated by the current control signal has the predetermined current value (I) when i≥3, is half the predetermined current value (I), i.e., (½)I, when i=2, and is a quarter of the predetermined current value (I), i.e., (¼)I, when i=1. It is noted that, by using the reference current of FIG. 12C, the refresh rate of each of the driving current signals can be raised compared to that of the example in which the reference current of FIG. 11C is used, and can be almost double as M increases.

Figure 13:
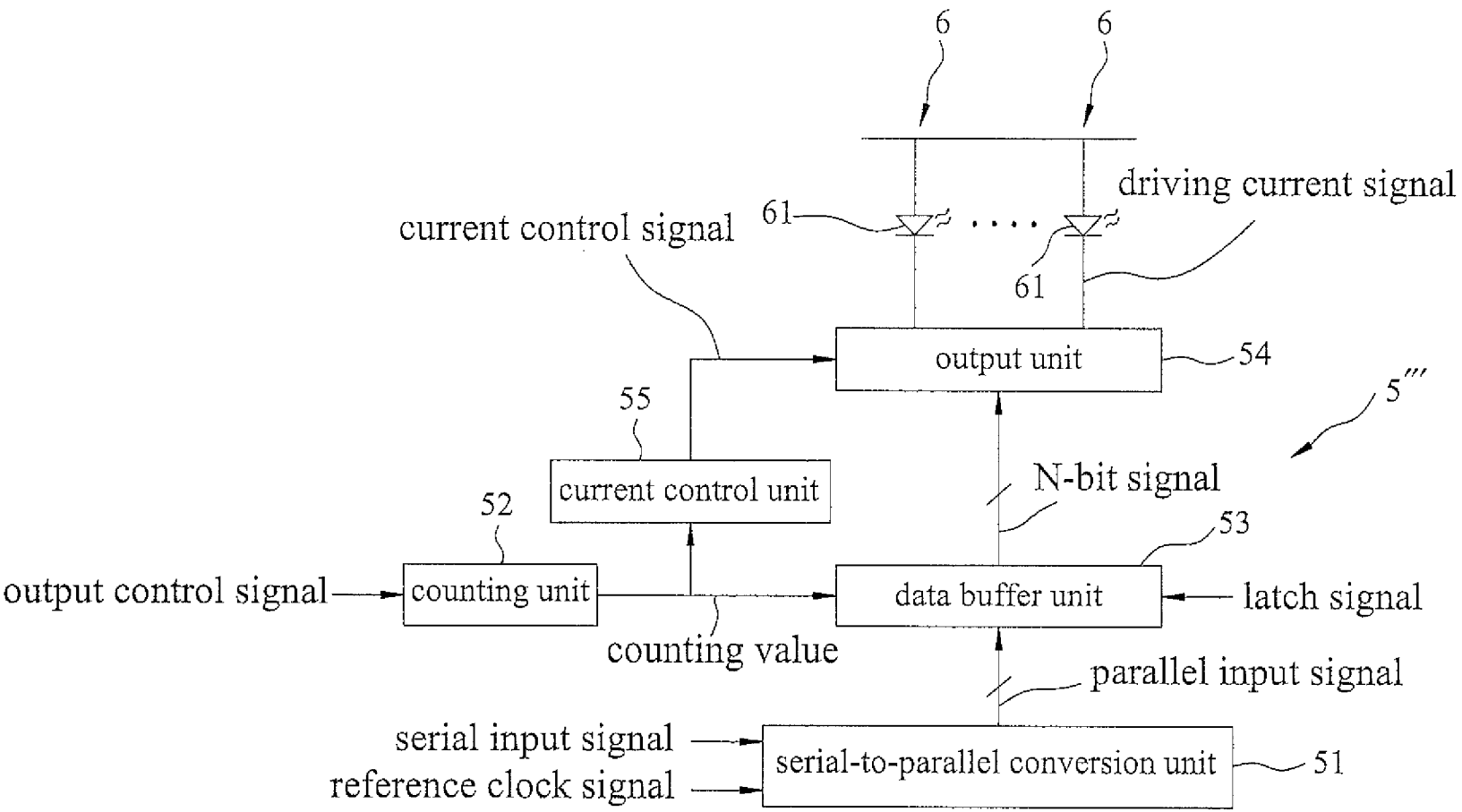
FIG. 13 is a schematic block diagram illustrating the fourth preferred embodiment of a light emitting diode driver according to this invention.

FIG. 13 illustrates the fourth preferred embodiment of an LED driver 5''' according to this invention, and the LED driver 5''' of this embodiment is a modification of the third preferred embodiment. Unlike the third preferred embodiment, the output unit 54 generates the driving current signals based only on the N-bit signal and the current control signal.

Figures 14A, 14B, 14C:
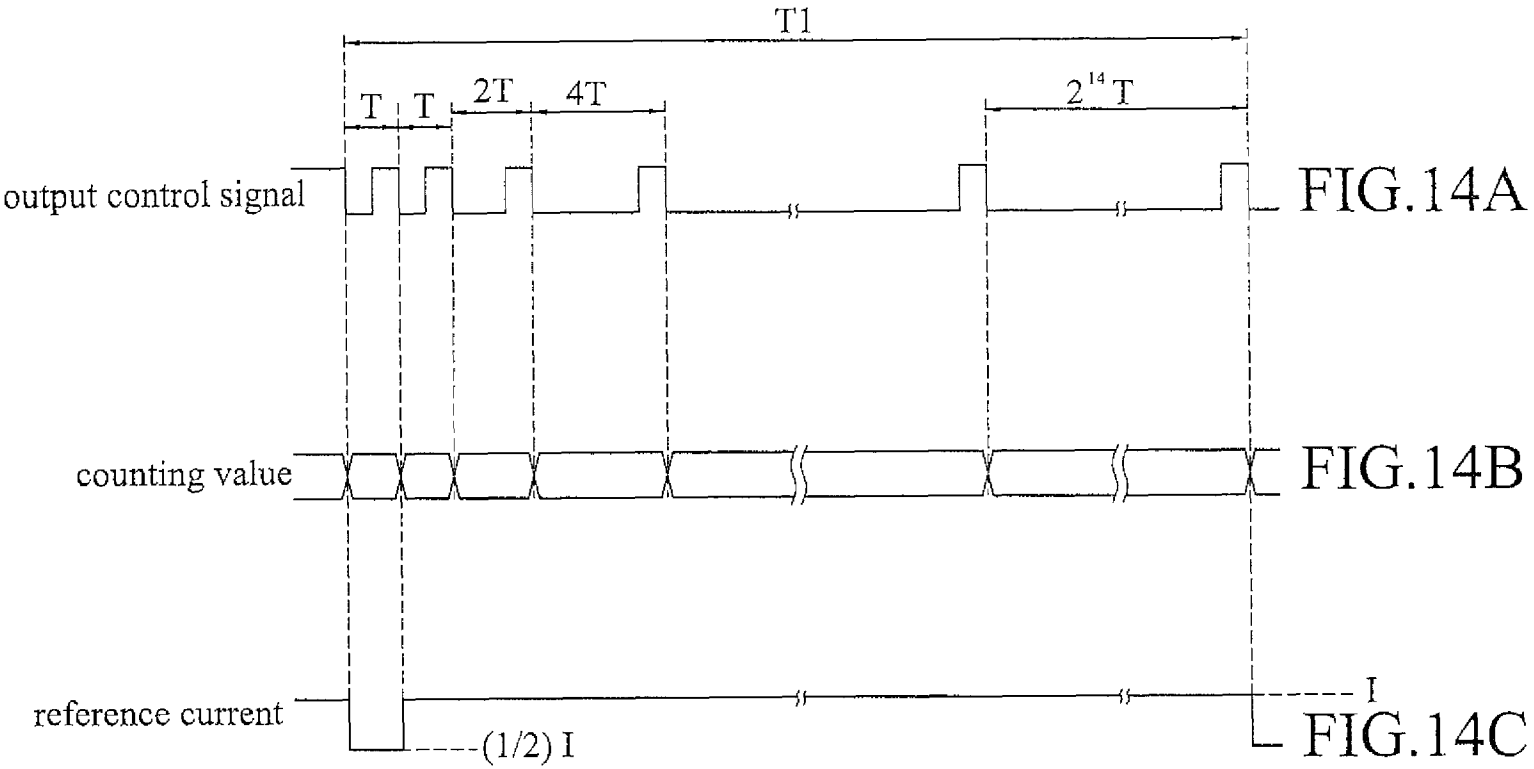
FIGS. 14A to 14C are exemplary timing diagrams illustrating an output control signal, a counting value and a reference current of the light emitting diode driver of the fourth preferred embodiment, respectively.

In addition, the output control signal used in this embodiment differs from the output control signal (see FIGS. 11A and 12A) used in the third preferred embodiment, and is a variation of the output control signal (see FIG. 8A) used in the second preferred embodiment. For example, as shown in FIG. 14A, during each cycle (T1) of the output control signal, a time period between two adjacent falling-edge transitions of the output control signal is represented as a sequence of T, T, 2T, 4T, 8T, . . . , and $2^{14}$T. In this case, similar to the third preferred embodiment, the counting value outputted by the counting unit 52 changes upon each falling-edge transition of the output control signal, as shown in FIG. 14B.

In accordance with the counting value of FIG. 14B, the current control unit 55 configures the current control signal so that the reference current indicated by the current control signal has a predetermined current value (I) when i≥2, and is half the predetermined current value (I), i.e., (½)I, when i=1, as shown in FIG. 14C.

Therefore, the current value of each of the driving current signals is constant during each time period between corresponding two adjacent falling-edge transitions of the output control signal, and is determined to be the value of the reference current or zero based on the N-bit signal, irrelevant to the output control signal. In other words, each of the light emitting units 6 emits light in the whole cycle (T1) of the output control signal when each of the bits of the respective one of the M-bit gray codes is '1'.

Figures 15A, 15B, 15C:
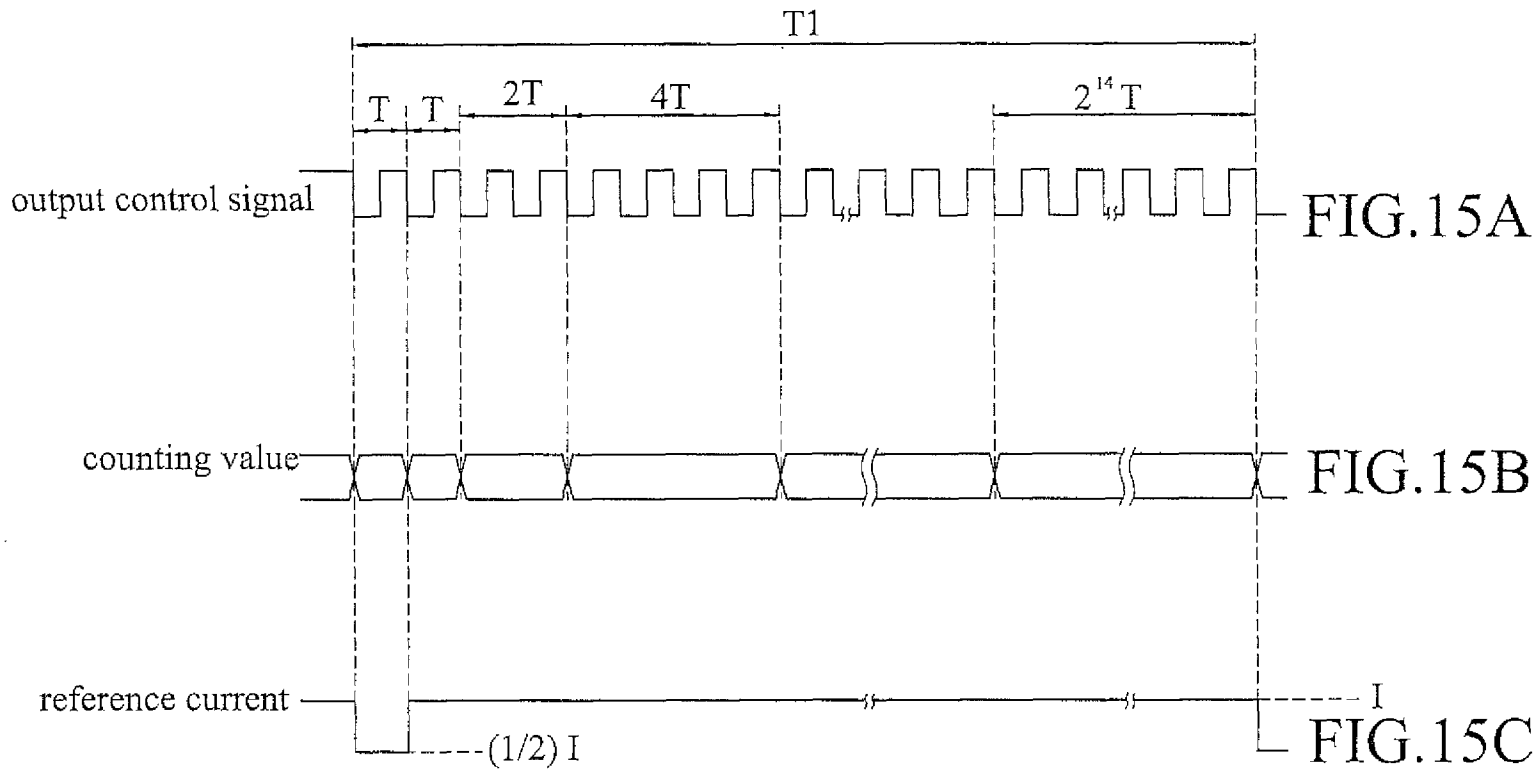
FIGS. 15A to 15C are another exemplary timing diagrams illustrating the output control signal, the counting value and the reference current of the light emitting diode driver of the fourth preferred embodiment, respectively.

FIGS. 15A to 15C illustrate three other examples of the output control signal, the counting value and the reference current, respectively. In this example, the output control signal, similar to the output control signal (see FIG. 9A) used in the second preferred embodiment, periodically changes between the first and second levels by a predetermined frequency during each cycle (T1). In this case, as shown in FIG. 15B, the counting unit 52 changes the counting value upon each of first and $(2^{j-2})^{th}$ falling-edge transitions of the output control signal during each cycle (T1) of the output control signal, where 2≤j≤M. Accordingly, during each cycle (T1) of the output control signal, duration of the counting value is represented as a sequence of T, T, 2T, 4T, 8T, . . . , and $2^{14}$T. In addition, in this example, the reference current shown in FIG. 15C is similar to the reference current of FIG. 14C.

Figures 16A, 16B, 16C:
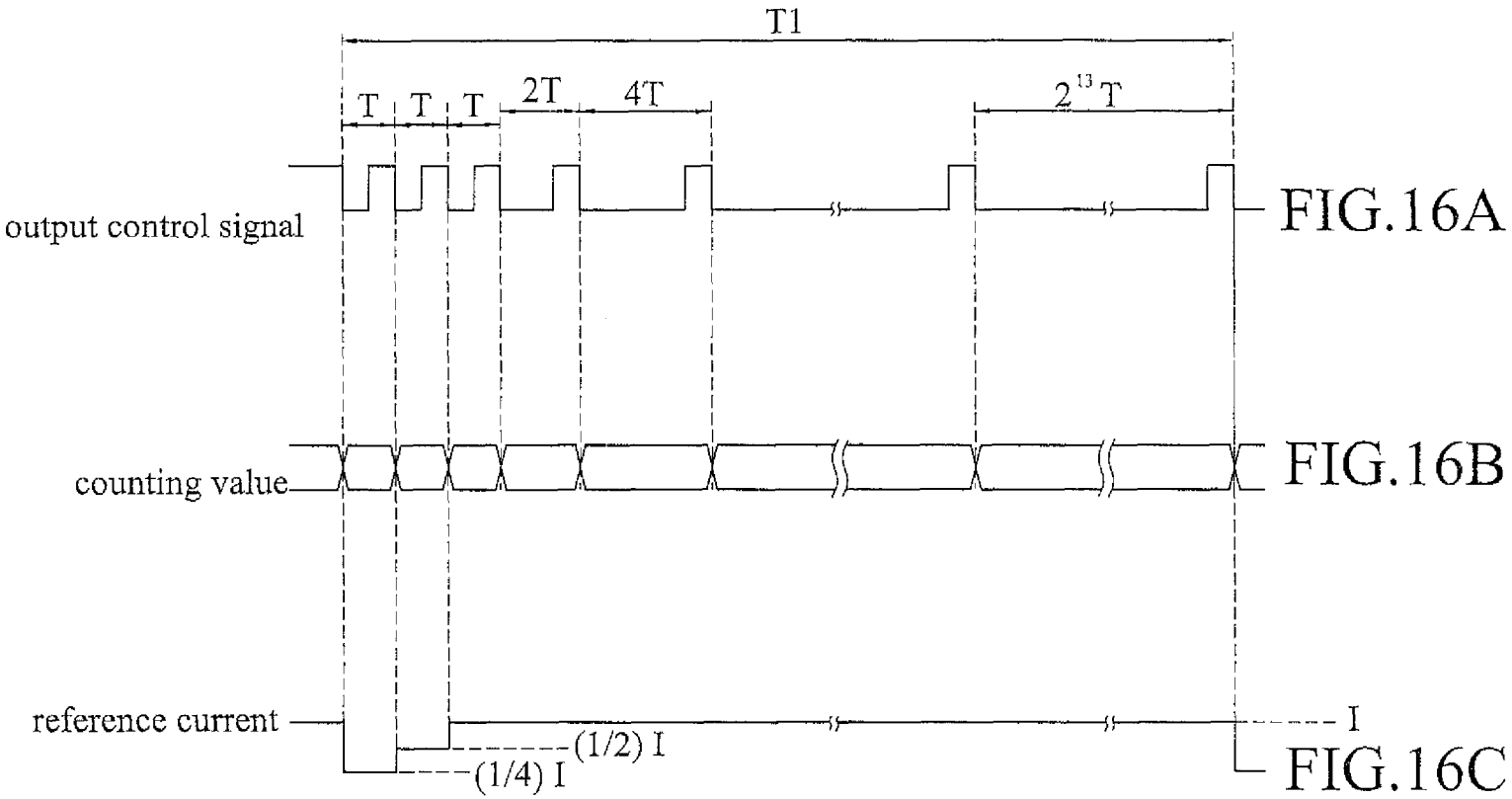
FIGS. 16A to 16C are yet another exemplary timing diagrams illustrating the output control signal, the counting value and the reference current of the light emitting diode driver of the fourth preferred embodiment, respectively.

FIGS. 16A to 16C illustrate three more examples of the output control signal, the counting value and the reference current, respectively. In this example, the output control signal is a variation of the output control signal of FIG. 14A. Unlike the output control signal of FIG. 14A, during each cycle (T1) of the output control signal, a time period between two adjacent falling-edge transitions of the output control signal is represented as a sequence of T, T, T, 2T, 4T, 8T, . . . , and $2^{13}$T. In this case, similar to the third preferred embodiment, the counting value outputted by the counting unit 52 changes upon each falling-edge transition of the output control signal, as shown in FIG. 16B. In accordance with the counting value of FIG. 16B, the current control unit 55 configures the current control signal, so that the reference current indicated by the current control signal has the predetermined current value (I) when i≥3, is half the predetermined current value (I), i.e., (½)I, when i=2, and is a quarter of the predetermined current value (I), i.e., (¼)I, when i=1, as shown in FIG. 16C. Accordingly, the current value of each of the driving current signals is constant during each time period between corresponding two adjacent falling-edge transitions of the output control signal, and is determined to be the value of the reference current or zero based on the N-bit signal, irrelevant to the output control signal. In other words, each of the light emitting units 6 emits light in the whole cycle (T1) of the output control signal when each of the bits of the respective one of the M-bit gray codes is '1'.

Figures 17A, 17B, 17C:
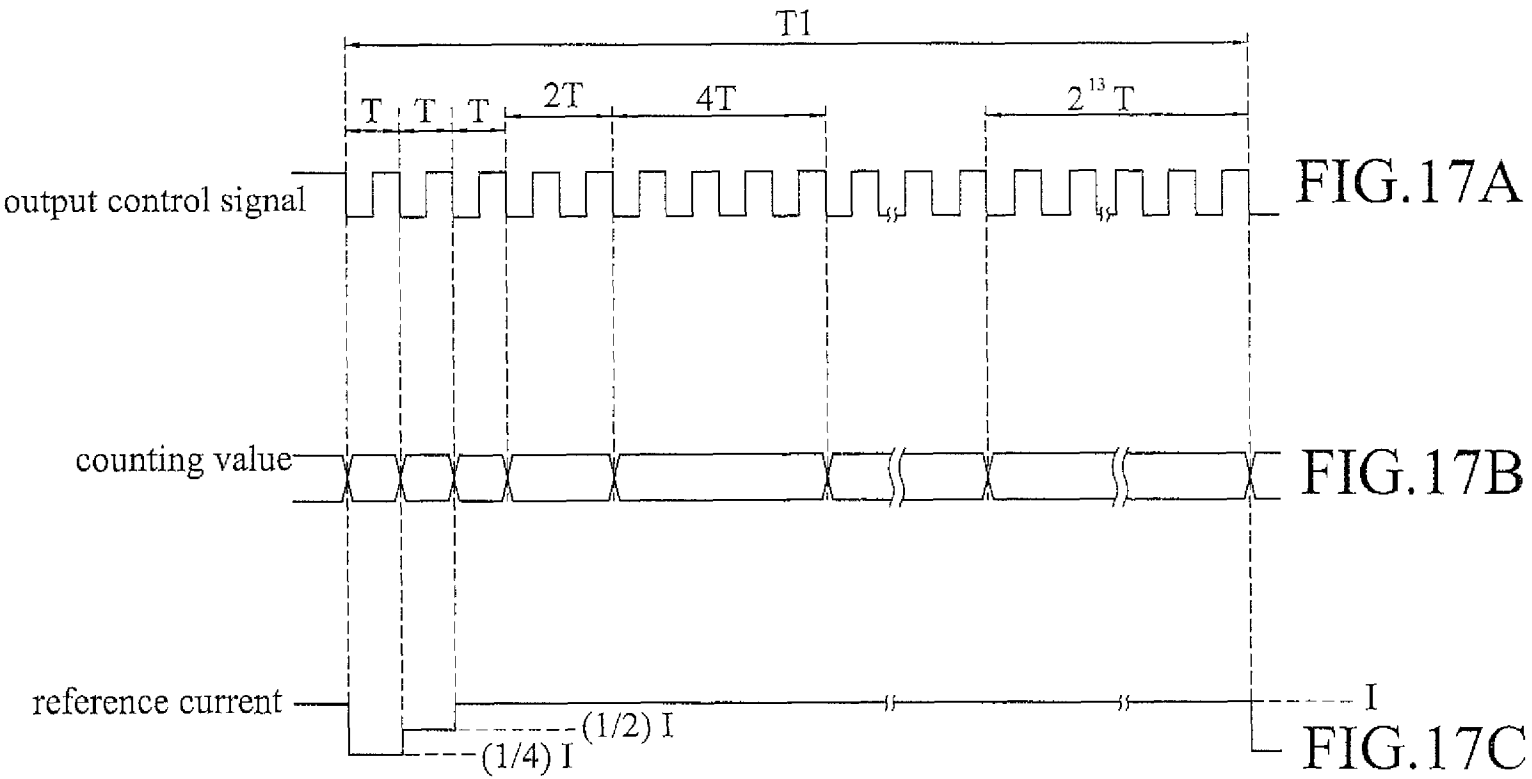
FIGS. 17A to 17C are further exemplary timing diagrams illustrating the output control signal, the counting value and the reference current of the light emitting diode driver of the fourth preferred embodiment, respectively.

FIGS. 17A to 17C illustrate three further examples of the output control signal, the counting value and the reference current. In this example, the output control signal shown in FIG. 17A is similar to the output control signal of FIG. 15A. In addition, during each cycle (T1) of the output control signal, the counting unit 52 changes the counting value upon each of first, second and $(2^{j-3}+2)^{th}$ falling-edge transitions of the output control signal, where 2≤j≤M, as shown in FIG. 173. Accordingly, during each cycle (T1) of the output control signal, duration of the counting value is represented as a sequence of T, T, T, 2T, 4T, 8T, . . . , and $2^{13}$T. In this example, the reference current shown in FIG. 17C is similar to the reference current of FIG. 16C.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. A light emitting diode (LED) driver for generating a number (N) of driving current signals for respectively driving a number (N) of light emitting units, where N≥2, each of the light emitting units including at least one LED, said LED driver comprising:

a serial-to-parallel conversion unit adapted to receive a reference clock signal, and a serial input signal carrying a number (N) of M-bit gray codes, where M≥2, said serial-to-parallel conversion unit being operable to convert, based on the reference clock signal, the serial input signal into a parallel input signal carrying the M-bit gray codes;

a counting unit adapted to receive an output control signal, and operable to count the output control signal so as to output a counting value;

a data buffer unit adapted to receive a latch signal and coupled to said serial-to-parallel conversion unit and said counting unit for receiving the parallel input signal and the counting value respectively therefrom, said data buffer unit being operable to store, based on the latch signal, the M-bit gray codes carried by the parallel input signal, and to output, based on the counting value and the M-bit gray codes, an N-bit signal consisting of a number (N) of bits, each of which is an $i^{th}$ one of M bits of a respective one of the M-bit gray codes, where $1 \leq i \leq M$ and i is associated with the counting value; and an output unit coupled to said data buffer unit for receiving the N-bit signal therefrom, said output unit being operable to generate the driving current signals based on at least the N-bit signal.

2. The LED driver of claim 1, the output control signal non-periodically changing between first and second levels during each cycle, wherein said counting unit changes the counting value upon each transition of the output control signal from a selected one of the first and second levels to the other of the first and second levels.

3. The LED driver of claim 2, wherein said output unit further receives the output control signal, and is operable to generate the driving current signals based on the output control signal and the N-bit signal, such that each of the driving current signals has a current value, which is determined based on a respective one of the bits of the N-bit signal when the output control signal is at the first level, and which is zero when the output control signal is at the second level.

4. The LED driver of claim 2, wherein each of the driving current signals generated by said output unit has a current value that is determined based on a respective one of the bits of the N-bit signal.

5. The LED driver of claim 1, the output control signal periodically changing between first and second levels during each cycle, wherein said counting unit changes the counting value upon each $(2^{j-1})^{th}$ transition of the output control signal from a selected one of the first and second levels to the other of the first and second levels during the cycle of the output control signal, where $1 \leq j \leq M$.

6. The LED driver of claim 1, further comprising a current control unit that is coupled to said counting unit and said output unit, and that is adapted to receive the counting value from said counting unit, said current control unit being operable to generate, based on the counting value, a current control signal indicating a reference current, and to output the current control signal to said output unit;

wherein said output unit further receives the current control signal from said current control unit, and is operable to generate the driving current signals based on at least the N-bit signal and the current control signal.

7. The LED driver of claim 6, wherein said current control unit configures the current control signal so that the reference current indicated by the current control signal has a predetermined current value when $i \geq 2$ and is half the predetermined current value when $i=1$.

8. The LED driver of claim 7, the output control signal periodically changing between first and second levels during each cycle, wherein said counting unit changes the counting value upon each of first and $(2^{j-2})^{th}$ transitions of the output control signal from a selected one of the first and second levels to the other of the first and second levels during the cycle of the output control signal, where $2 \leq j \leq M$.

9. The LED driver of claim 6, wherein:

$M \geq 3$; and said current control unit configures the current control signal so that the reference current indicated by the current control signal has a predetermined current value when $i \geq 3$, is half the predetermined current value when $i=2$, and is a quarter of the predetermined current value when $i=1$.

10. The LED driver of claim 9, the output control signal periodically changing between first and second levels during each cycle, wherein said counting unit changes the counting value upon each of first, second and $(2^{j-3}+2)^{th}$ transitions of the output control signal from a selected one of the first and second levels to the other of the first and second levels during the cycle of the output control signal, where $3 \leq j \leq M$.

11. The LED driver of claim 6, the output control signal non-periodically changing between first and second levels during each cycle, wherein said counting unit changes the counting value upon each transition of the output control signal from a selected one of the first and second levels to the other of the first and second levels.

12. The LED driver of claim 11, wherein said output unit further receives the output control signal, and is operable to generate the driving current signals based on the output control signal, the current control signal and the N-bit signal, such that each of the driving current signals has a current value, which is determined based on a respective one of the bits of the N-bit signal to be a value of the reference current or zero when the output control signal is at the first level, and which is zero when the output control signal is at the second level.

13. The LED driver of claim 11, wherein each of the driving current signals generated by said output unit has a current value that is determined based on a respective one of the bits of the N-bit signal to be a value of the reference current or zero.

* * * * *